US005879200A

United States Patent [19]

Sugie

[11] Patent Number: 5,879,200

[45] Date of Patent: Mar. 9, 1999

[54] CONNECTOR TERMINAL PRESS-FITTING CONSTRUCTION

[75] Inventor: Naoto Sugie, Shizuoka, Japan

[73] Assignee: Yazaki Corporation, Tokyo, Japan

[21] Appl. No.: 883,711

[22] Filed: Jun. 27, 1997

[30] Foreign Application Priority Data

Jun. 28, 1996 [JP] Japan ..... 8-170007

[51] Int. Cl.[6] ..... H01R 13/40

[52] U.S. Cl. ..... 439/733.1

[58] Field of Search ..... 439/733.1, 869

[56] References Cited

U.S. PATENT DOCUMENTS 5,071,372 12/1991 Viselli et al. ..... 439/733.1
5,586,915 12/1996 Baker et al. ..... 439/733.1

FOREIGN PATENT DOCUMENTS 64-36981 3/1989 Japan .
3-32369 3/1991 Japan .
6-68927 3/1994 Japan .

*Primary Examiner*—Neil Abrams
*Assistant Examiner*—Barry M. L. Standig
*Attorney, Agent, or Firm*—Sughrue, Mion, Zinn, Macpeak & Seas, PLLC

[57] ABSTRACT

In a connector terminal press-fitting construction, a terminal is press-fitted into a terminal press-fitting hole formed in a wall of a housing, and a press-fitting portion of the terminal is held by holding portions provided in the terminal press-fitting hole, thereby fixing the terminal. Rear-side holding portions for a front portion of the press-fitting portion of the terminal are formed at a rear end portion of the terminal press-fitting hole, and front-side holding portions for a rear portion of the press-fitting portion of the terminal are formed at a front end portion of the terminal press-fitting hole, and are disposed at such a position that the front-side holding portions are irrelevant to the holding of the front portion of the press-fitting portion when the front portion passes through the front end portion of the terminal press-fitting hole. In addition, a region, which is irrelevant to the holding of the terminal, is provided between the rear-side holding portions and the front-side holding portions.

3 Claims, 5 Drawing Sheets

22
24
15a
15b
6
6a
6b
17a
17b
18a
18b
13
1
L
L1
L2
L3(24)
(15a)
(15b)

CONNECTOR TERMINAL PRESS-FITTING CONSTRUCTION

BACKGROUND OF THE INVENTION

1. Field of the Invention

This invention relates to a connector terminal press-fitting construction.

2. Description of the Related Art

FIG. 3 shows a connector terminal press-fitting construction disclosed in Japanese Utility Model Unexamined Publication No. Hei. 3-32369.

In this figure, a terminal press-fitting hole 2 for fixedly holding a terminal (male terminal) 3 is formed through a wall 1 of a connector housing. The terminal 3 has a press-fitting portion 6 (serving as a fixing portion) of a greater width provided at intermediate opposite ends thereof. The terminal press-fitting hole 2 has a substantially square shape corresponding to a square cross-section of the press-fitting portion 6 of the terminal 3. Holding portions 5 are formed at opposite side portions of opposed surfaces 2*a* of the square terminal press-fitting hole 2 which are opposed to each other in a direction corresponding to a direction X of the thickness of the terminal 3. The holding portions 5 extend over the entire length of the terminal press-fitting hole 2. The holding portions 5 hold the press-fitting portion 6 of the terminal 3 in the direction X of the thickness thereof. The distance a1 between the opposed surfaces of each holding portion 5 is slightly smaller than the thickness b1 of the press-fitting portion 6 of the terminal 3.

In this construction, when the press-fitting portion 6 of the terminal 3 is press-fitted into the terminal press-fitting hole 2, portions 7 which are to be held (indicated by hatching), provided respectively at opposite side portions of the press-fitting portion 6 of the terminal 3, are held respectively by the holding portions 5, so that the terminal 3 is fixedly secured to the connector housing.

FIG. 4 shows another conventional construction in which the press-fitting portion of the terminal is slightly modified, and accordingly the shape of the terminal press-fitting hole is slightly modified.

A press-fitting portion 6 of a terminal 13 has a front narrower portion 6*a* and a rear wider portion 6*b* greater in width than the narrower portion 6*a*. A terminal press-fitting hole 12 has a rear narrower portion 14*a* and a front wider portion 14*b* which correspond respectively to the narrower portion 6*a* and the wider portion 6*b* of the terminal 13. Dimensions g and h of the narrower and wider portions 6*a* and 6*b* of the terminal 13 and dimensions k and j of the narrower and wider portions 14*a* and 14*b* of the terminal press-fitting hole 12 are so determined that the relation, $g<k<h<j$, is established. Therefore, with this construction, a holding force, acting in the direction of the width, is not obtained upon press-fitting of the terminal.

Holding portions 15 are formed at opposite side portions of opposed surfaces 12*a* of the square terminal press-fitting hole 12 which are opposed to each other in a direction corresponding to a direction X of the thickness of the terminal 13. The holding portions 15 extend over the entire length of the terminal press-fitting hole 12 including the wider portion 14*b* and the narrower portion 14*a*. The holding portions 15 hold the press-fitting portion 6 of the terminal 13 in the direction X of the thickness thereof. As in the above-mentioned construction, the distance a1 between the opposed surfaces of each holding portion 15 is slightly smaller than the thickness b1 of the press-fitting portion 6 of the terminal 13. The width i of those portions (i.e., relief portions for preventing interference) of the opposed surfaces 12*a* except the holding portions 15 at the opposite side portions thereof, and the distance n between the opposed surfaces 12*a* are so determined that the relation, $i<g$, and the relation, $b1<n$, are established.

In this construction, when the press-fitting portion 6 of the terminal 13 is press-fitted into the terminal press-fitting hole 12, portions 17 which are to be held (indicated by hatching) of the press-fitting portion 6 of the terminal 13 are held respectively by the holding portions 15, so that the terminal 13 is fixedly secured to the connector housing.

In this case, upon reviewing three stages of the press-fitting process shown respectively in FIGS. 5(*a*), 5(*b*) and 5(*c*), holding forces of the holding portions 15 of the terminal press-fitting hole 12 begin to act on the to-be-held portions 17 of the terminal 13 when a front end 18*a* of the narrower portion 14*a* of the press-fitting portion 6 of the terminal 13 reaches an inlet of the terminal press-fitting hole 12 (that is, when the front end 18*a* begins to interfere with the holding portions 15 as shown in FIG. 5(*a*), and therefore from this stage, the press-fitting force-must be applied against these holding forces, and the press-fitting force must be increased as the insertion of the terminal 13 proceeds.

Then, from the time when the front ends 18*a* and 18*b* of the narrower and wider portions 6*a* and 6*b* of the press-fitting portion 6 of the terminal 13 reach the narrower and wider portions 14*a* and 14*b* of the terminal press-fitting hole 12, respectively (as shown in FIG. 5(*b*)), to the time when the press-fitting is completed (as shown in FIG. 5(*c*)), the press-fitting force must be further increased.

Therefore, in the above conventional construction, when the press-fitting of the terminal 13 is started, the large press-fitting force must be applied from the beginning to the end, and therefore the efficiency of the press-fitting operation is poor. This is the same with the conventional construction of FIG. 3.

SUMMARY OF THE INVENTION

With the above problems in view, it is an object of this invention to provide a connector terminal press-fitting construction in which a period, during which a press-fitting force is applied, is shortened, thereby improving the efficiency of the press-fitting operation.

According to the invention, there is provided a connector terminal press-fitting construction wherein a terminal is press-fitted into a terminal press-fitting hole formed in a wall of a housing, and a press-fitting portion of the terminal is held by holding portions provided in the terminal press-fitting hole, thereby fixing the terminal, the construction comprising: rear-side holding portions for a front portion of the press-fitting portion of the terminal, the rear-side holding portions being formed at a rear end portion of the terminal press-fitting hole; front-side holding portions for a rear portion of the press-fitting portion of the terminal, the front-side holding portions being formed at a front end portion of the terminal press-fitting hole and disposed at such a position that the front-side holding portions are irrelevant to the holding of the front portion of the press-fitting portion when the front portion passes through the front end portion of the terminal press-fitting hole; and a region which is irrelevant to the holding of the terminal, the region being provided between the rear-side holding portions and the front-side holding portions.

DETAILED DESCRIPTION OF THE PREFERRED EMBODIMENT

A preferred embodiment of the present invention will now be described with reference to the drawings.

Figure 1:
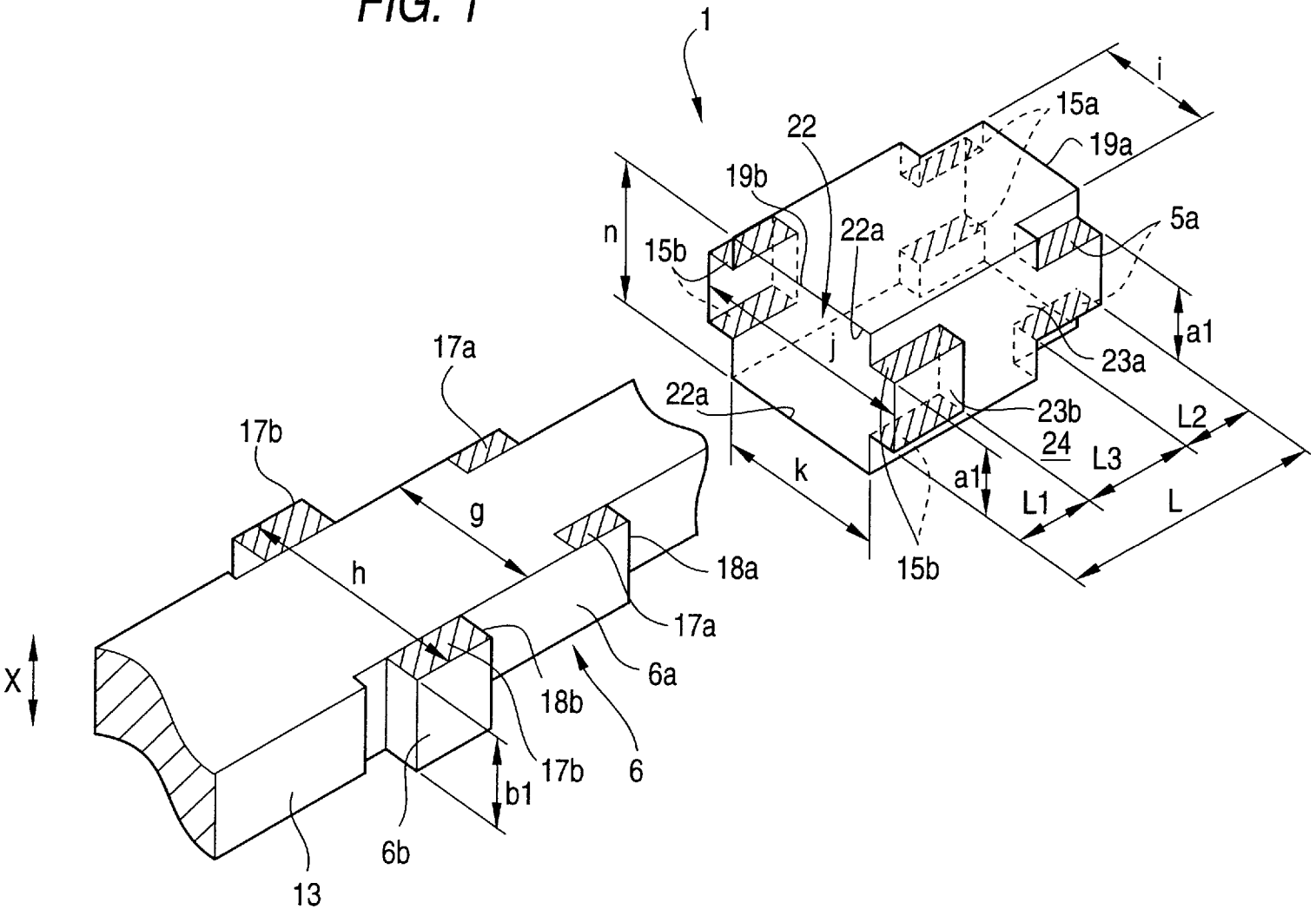
FIG. 1 is a perspective view showing the relation between a terminal and a terminal press-fitting hole in a preferred embodiment of the invention.
Figure 4:
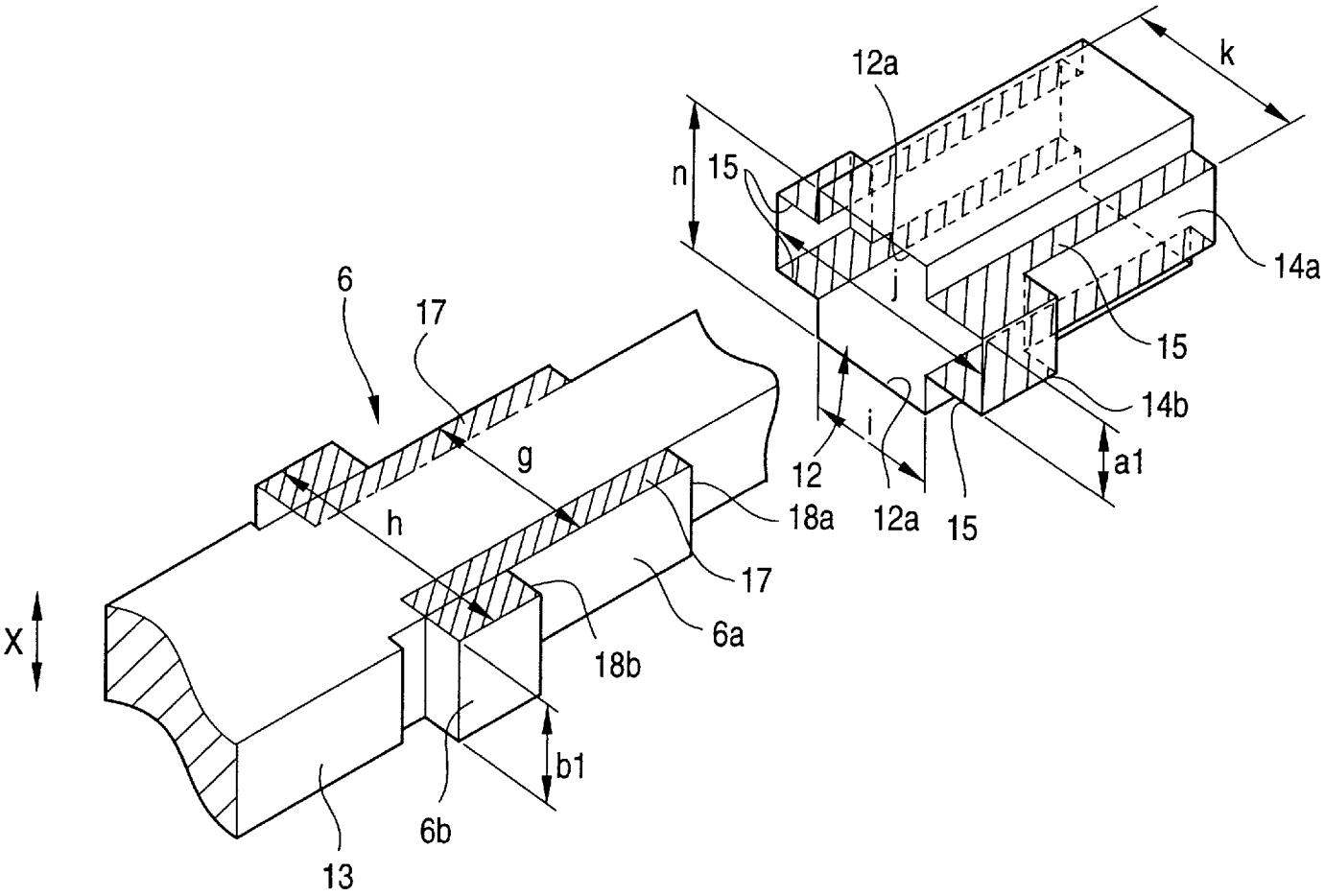
FIG. 4 PRIOR ART
FIG. 4 is a perspective view showing the relation between a terminal and a terminal press-fitting hole in another conventional construction.
Figure 5:
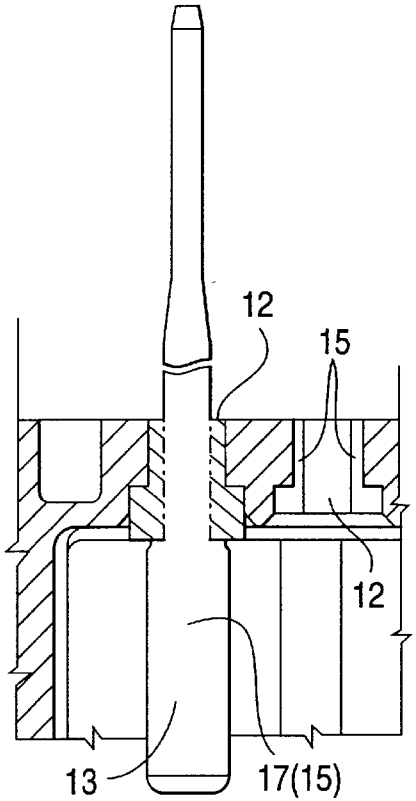
FIG. 5 (c) PRIOR ART
FIGS. 5(*a*) to 5(*c*) are cross-sectional views showing a terminal press-fitting process in the construction of FIG. 4, FIG. 5(*a*) showing a first step, FIG. 5(*b*) showing a third step after a second step, and FIG. 5(*c*) showing a state in which the press-fitting operation is completed by effecting the third step.
Figure 5:
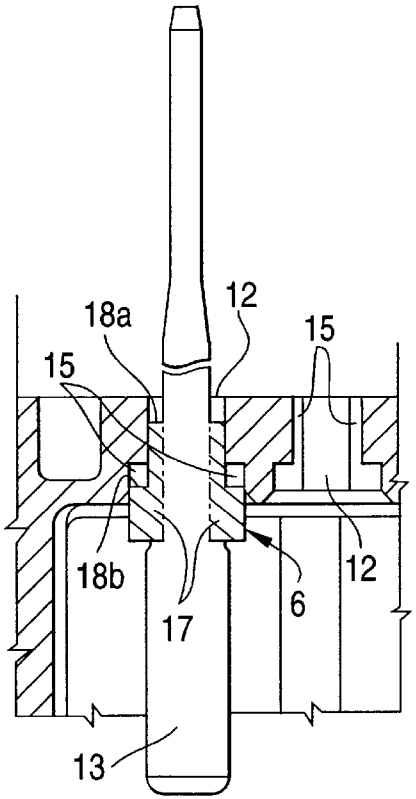
FIG. 5 (b) PRIOR ART
Figure 5:
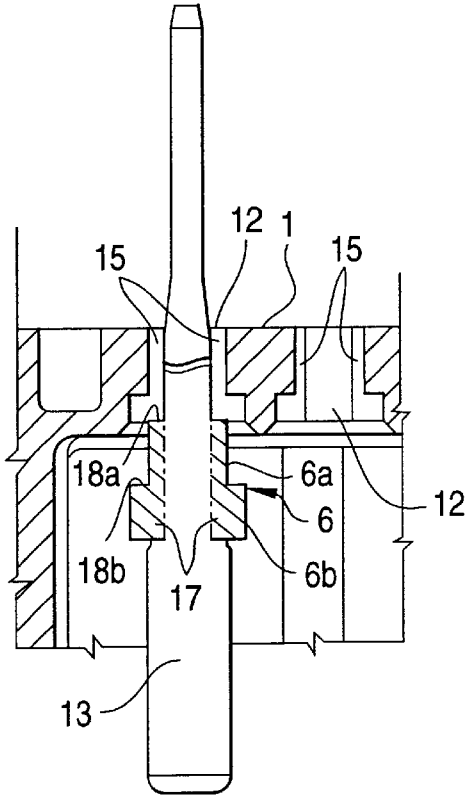
FIG. 5 (a) PRIOR ART

FIG. 1 is a perspective view showing the relation between a terminal 13 and a terminal press-fitting hole 22 in the construction of this embodiment. In this embodiment, the terminal 13 is the same as that shown in FIG. 4, and the terminal press-fitting hole 22 is a slight modification of that shown in FIG. 4.

The terminal press-fitting hole 22 has a rear narrower portion 23*a* and a front wider portion 23*b* which correspond respectively to a narrower portion 6*a* and a wider portion 6*b* of the terminal 13. As in the construction of FIG. 4, dimensions g and h of the narrower and wider portions 6*a* and 6*b* of the terminal 13 and dimensions k and j of the narrower and wider portions 23*a* and 23*b* of the terminal press-fitting hole 22 are so determined that the relation, $g<k<h<j$, is established.

At opposite side portions of opposed surfaces 22*a* of the square terminal press-fitting hole 22 which are opposed to each other in a direction corresponding to a direction X of the thickness of the terminal 13, rear-side holding portions 15*a* are formed at the narrower portion 23*a* while front-side holding portions 15*b* are formed at the wider portion 23*b*. The rear-side holding portions 15*a* respectively hold portions 17*a* which are to be held (indicated by hatching) provided at the narrower portion 6*a* of a press-fitting portion 6 of the terminal 13, and the front-side holding portions 15*b* respectively hold portions 17*b* which are to be held (indicated by hatching) provided at the wider portion 6*b* of the press-fitting portion 6. The rear-side holding portions 15*a* are spaced a predetermined distance from the front-side holding portions 15*b*. As described above for the conventional construction, the distance a1 between the opposed surfaces of each of the holding portions 15*a* and 15*b* is slightly smaller than the thickness b1 of the press-fitting portion 6 of the terminal 13.

Those portions (relief portions) 19*a* of the opposed surfaces 22*a* (disposed at the narrower portion 23*a*) except the holding portions 15*a* and 15*a* provided respectively at the opposite side portions thereof has a width i, and those portions (relief portions) 19*b* of the opposed surfaces 22*a* (disposed at the wider portion 23*b*) except the holding portions 15*b* and 15*b* provided respectively at the opposite side portions thereof has a width k equal to the width of the narrower portion 23*a,* and the opposed surfaces 22*a* are spaced a distance n from each other. The relation, $i<g$, and the relation, $b1<n$, are established.

A region 24 of a predetermined length, which is irrelevant to the holding of the terminal 13, is provided between the rear-side holding portions 15*a* and the front-side holding portions 15*b*. This region 24 is obtained by the arrangement in which the width of the front portions of the opposed surfaces 22*a* (that is, the width k of the front relief portions 19*b*) is larger than the width g of the narrower portion 6*a* of the press-fitting portion 6 of the terminal 13 so that the narrower portion 6*a,* when passing through the front portion of the terminal press-fitting hole 22, will not interfere with the inner surface of the terminal press-fitting hole 22. Therefore, the narrower portion 6*a* of the press-fitting portion 6 of the terminal 13, when passing through the front portion of the terminal press-fitting hole 22, will not interfere with the front-side holding portions 15*b* provided outwardly of (that is, on the opposite sides of) the relief portions 19*b*. In this embodiment, the terminal press-fitting hole 22 has a depth or length L, and this hole 22 has the holding portions 15*b* of a length L1, which are provided at its front end portion, and correspond to the wider portion 6*b* of the terminal 13, the region 24 of a length L3, which extends rearwardly therefrom, and is irrelevant to the holding, and the holding portions 15*a* of a length L2 which are provided at its rear end portion, and correspond to the narrower portion 6*a* of the terminal 13. The relation, $L=L1+L2+L3$, is established.

In this construction, when the press-fitting portion 6 of the terminal 13 is press-fitted into the terminal press-fitting hole 22, the front-side to-be-held portions 17*a* (indicated by hatching) of the press-fitting portion 6 of the terminal 13 are held respectively by the rear-side holding portions 15*a* while the rear-side to-be-held portions 17*b* (indicated by hatching) of the press-fitting portion 6 of the terminal 13 are held respectively by the front-side holding portions 15*b,* so that the terminal 13 is fixedly secured to a connector housing.

Figure 2:
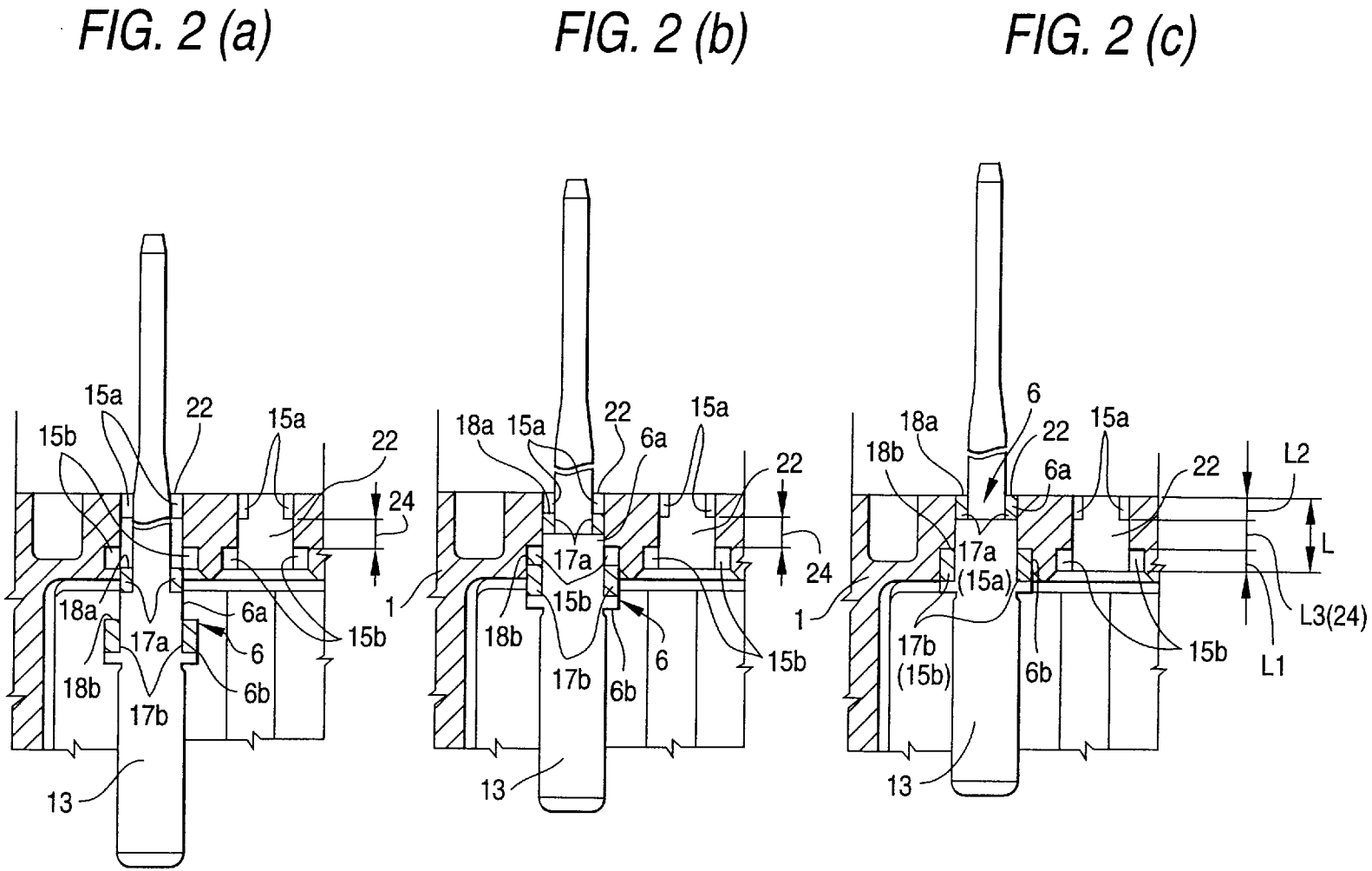
FIGS. 2(*a*) to 2(*c*) are cross-sectional views showing a terminal press-fitting process in the embodiment of the invention, FIG. 2(*a*) showing a first step, FIG. 2(*b*) showing a third step after a second step, and FIG. 2(*c*) showing a state in which the press-fitting operation is completed by effecting the third step.
Figure 3:
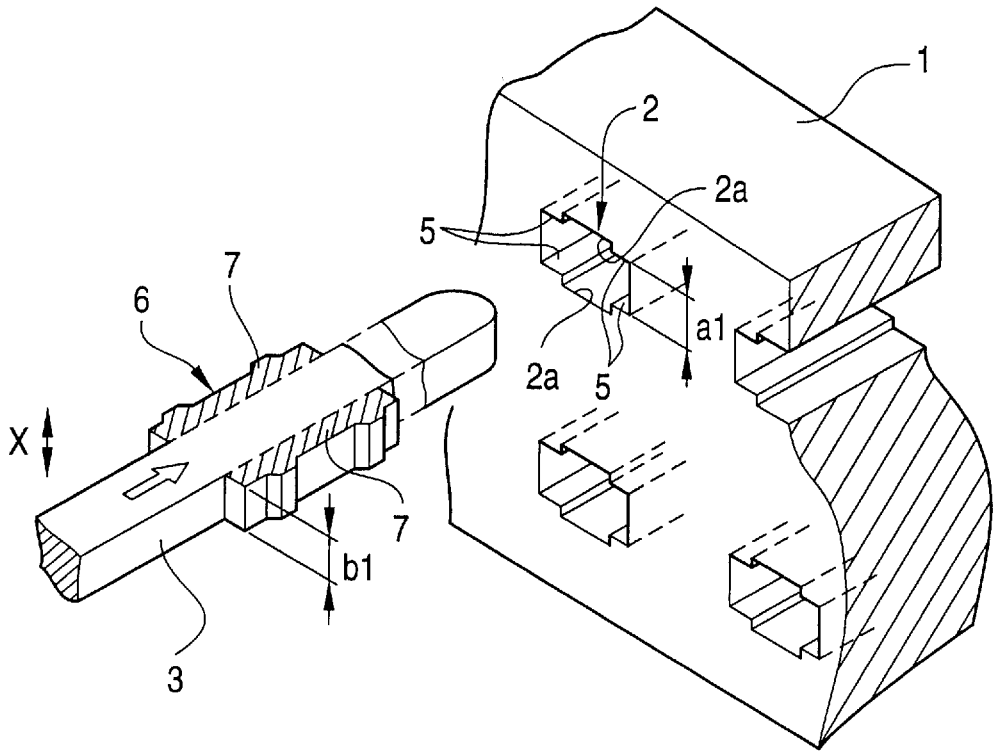
FIG. 3 PRIOR ART
FIG. 3 is a perspective view showing the relation between a terminal and a terminal press-fitting hole in a conventional construction.

Next, the press-fitting operation will be described using FIG. 2 showing the press-fitting process.

In this construction, the process of press-fitting the terminal 13 into the terminal press-fitting hole 22 can be divided into three stages (steps). FIG. 2(*a*) shows the first step, FIG. 2(*b*) shows the third step after the second step, and FIG. 2(*c*) shows a state in which the press-fitting operation is completed by effecting the third step.

At the first stage, as shown in FIG. 2(*a*), a front end 18*a* of the narrower portion 6*a* of the press-fitting portion 6 reaches an inlet of the terminal press-fitting hole 22, and then passes through the front-side holding portions 15*b* of the terminal press-fitting hole 22. In this step, the front-side holding portions 15*b* do not hold the press-fitting portion 6 of the terminal 13, and therefore the terminal 13 can be inserted with a small force.

At the next stage, that is, the second stage, the narrower portion 6*a* of the press-fitting portion 6 advances through the region 24 from the front-side holding portions 15*b* to the rear-side holding portions 15*a*. This region 24 is irrelevant to the holding of the terminal 13, and therefore the terminal can be inserted with a small force as at the preceding stage, that is, the first stage.

At the final stage, that is, the third stage, as shown in FIG. 2(*b*), the front end 18*a* of the narrower portion 6*a* of the press-fitting portion 6 reaches the rear-side holding portions 15*a* of the terminal press-fitting hole 22, and then is press-fitted into these holding portions 15*a,* and at the same time a front end 18*b* of the wider portion 6*b* of the press-fitting portion 6 reaches the front-side holding portions 15*b,* and then is press-fitted into these holding portions 15*b*. In this step, the two holding portions 15*a* and 15*b* apply holding forces to the press-fitting portion 6 of the terminal 13, and therefore a large press-fitting-force is required for the first time.

Thus, the press-fitting force is required only at the final stage (third step), and the large inserting force does not need to be applied at the initial stage of the press-fitting operation. Therefore, the efficiency of the press-fitting operation is enhanced, and the assembling operation can be effected easily. Besides, since the rear-side holding portions 15*a* hold the front narrower portion 6*a* of the press-fitting portion 6 of the terminal 13 while the front-side holding portions 15*b* hold the rear wider portion 6*b* of the press-fitting portion 6 of the terminal 13, the terminal 13 can be positively fixed without shaking.

The shapes of the press-fitting portion 6 and the terminal press-fitting hole 22, as well as the arrangement of the holding portions 15*a* and 15*b,* can be suitably modified.

As described above, when the process of press-fitting the press-fitting portion of the terminal into the terminal press-fitting hole is divided into three stages, the large press-fitting force is required from the beginning to the end in the conventional construction, whereas in the invention, the predetermined press-fitting force is required only at the final stage. Therefore, the efficiency of the terminal press-fitting operation is enhanced, and since the front and rear ends of the press-fitting portion of the terminal are positively held by the respective holding portions, the terminal can be fixed without shaking, and therefore will not be brought out of a proper posture.

What is claimed is:

1. A connector terminal press-fitting construction in which a terminal is press-fitted into a terminal press-fitting hole formed in a wall of a housing, and a press-fitting portion of the terminal is held by holding portions provided in the terminal press-fitting hole, thereby fixing the terminal, said construction comprising:

rear-side holding portions for a front portion of the press-fitting portion of the terminal, said rear-side holding portions being formed at a rear end portion of the terminal press-fitting hole;

front-side holding portions for a rear portion of the press-fitting portion of the terminal, said front-side holding portions being formed at a front end portion of the terminal press-fitting hole and disposed at such a position that said front-side holding portions are irrelevant to the holding of the front portion of the press-fitting portion of the terminal when the front portion passes through the front end portion of the terminal press-fitting hole; and a region which is irrelevant to the holding of the terminal, said region being provided between said rear-side holding portions and said front-side holding portions.

2. The connector terminal press-fitting construction according to claim 1, wherein the terminal press-fitting hole is formed into a substantially square shape corresponding to a cross-sectional shape of the press-fitting portion of the terminal, and said rear-side holding portions and said front-side holding portions, which hold the press-fitting portion of the terminal in a direction of a thickness of the terminal, are provided at opposite side portions of opposed surfaces of the substantially square terminal press-fitting hole, and wherein said front-side holding portions are provided outwardly of a region through which the front portion of the press-fitting portion of the terminal passes, and the rear portion of the press-fitting portion of the terminal is projected widthwise so as to correspond to a region where said front-side holding portions are provided.

3. The connector terminal press-fitting construction according to claim 1, wherein the press-fitting portion of the terminal comprises a narrower portion and a wider portion respectively corresponding to the front portion and the rear portion thereof while the terminal press-fitting hole comprises a narrower portion and a wider portion respectively including said rear-side holding portions and said front-side holding portions, and dimensions g and h of the narrower and wider portions of the terminal and dimensions k and j of the narrower and wider portions of the terminal press-fitting hole are so determined that a relation, $g<k<h<j$, is established.

* * * * *